US011529286B2

(12) United States Patent
Kenney et al.

(10) Patent No.: US 11,529,286 B2
(45) Date of Patent: Dec. 20, 2022

(54) PLASMA STORAGE APPARATUS

(71) Applicant: Drummond Scientific Company, Broomall, PA (US)

(72) Inventors: James Kenney, Broomall, PA (US); Russ Dettmann, Ridley Park, PA (US)

(73) Assignee: Drummond Scientific Company, Broomall, PA (US)

( * ) Notice: Subject to any disclaimer, the term of this patent is extended or adjusted under 35 U.S.C. 154(b) by 471 days.

(21) Appl. No.: 16/299,096

(22) Filed: Mar. 11, 2019

(65) Prior Publication Data

US 2020/0289368 A1 Sep. 17, 2020

(51) Int. Cl.

| | |
|---|---|
| ***A61J 1/05*** | (2006.01) |
| ***A61J 1/20*** | (2006.01) |
| ***A61J 1/14*** | (2006.01) |

(52) U.S. Cl.

CPC ..... *A61J 1/05* (2013.01); *A61J 1/1412* (2013.01); *A61J 1/20* (2013.01)

(58) Field of Classification Search

CPC ..... B01L 2300/043; B01L 2300/0858; B01L 2300/0838; B65D 51/00; A61J 1/1412; A61J 1/05; A61J 1/20; A61B 5/150343; A61B 5/150022; A61B 5/150305; A61B 5/15142

See application file for complete search history.

(56) References Cited

U.S. PATENT DOCUMENTS

| | | | | | |
|---|---|---|---|---|---|
| 4,024,857 | A * | 5/1977 | Blecher | A61B 5/150259 | 600/576 |
| 5,916,814 | A * | 6/1999 | Kenney | G01N 33/80 | 600/370 |
| 6,155,991 | A * | 12/2000 | Beat | A61B 5/150351 | 600/573 |
| 2010/0291669 | A1* | 11/2010 | Robinson | G01N 35/0099 | 901/14 |
| 2016/0100783 | A1* | 4/2016 | Ivosevic | A61B 5/15142 | 600/583 |

* cited by examiner

*Primary Examiner* — Ariana Zimbouski
(74) *Attorney, Agent, or Firm* — Ryder, Mazzeo & Konieczny LLC; Joseph M. Konieczny, Sr.

(57) ABSTRACT

An apparatus for storing blood plasma separated after fractionation from whole blood within a wrapped hematocrit (capillary) tube. The apparatus is large enough to receive and display a standard laboratory identification label. The apparatus stores plasma from a hematocrit tube that does not include thixotropic gel. The apparatus housing has an intended upright orientation, a central axis, a top end, a bottom end, and side walls defining an internal cavity. A wall with an upper surface and a lower surface divides the internal cavity into an upper cavity and a lower cavity. A reservoir is formed in the upper cavity. A removable cap seals the reservoir. The cap is movable between open and closed positions. A channel within the lower cavity extends axially from the bottom of the housing to the wall. The channel receives and supports the wrapped hematocrit tube while plasma is expelled therefrom and into the reservoir.

18 Claims, 17 Drawing Sheets

PLASMA STORAGE APPARATUS

FIELD OF THE INVENTION

The invention relates to an apparatus for storing fluid for medical or clinical testing. More particularly, the invention relates to an apparatus for storing blood plasma separated after fractionation from whole blood within a hematocrit (capillary) tube.

BACKGROUND OF THE INVENTION

Capillary tubes for performing hematocrit testing (also known as hematocrit tubes) are well known devices for collecting a blood sample from a patient. Wrapped hematocrit tubes, such as those sold by Drummond Scientific Company under the trademark HEMATO-CLAD®, have a protective film along the length of the glass tube except for a short portion at each end. The unwrapped portion of the glass tube has an outer diameter "OD1" while the overwrapped portion has an increased outer diameter "OD2". The distal end of the tube is open to admit blood and the proximal end has a porous plug, which seals when the tube is full and is contacted by blood.

In many experiments or tests, it is desirable to collect a small (micro-sized) sample of blood and separate (by centrifugation) the sample into its constituent parts, i.e., red blood cells and plasma, using a hematocrit tube. These hematocrit tubes may have a small volume, such as about 75 μl, and may be coated with an anticoagulant. Each tube also contains a small amount of thixotropic gel applied inside the capillary tube. When the tube (containing the blood sample) is centrifuged, the thixotropic gel migrates as a whole to the interface and acts like a liquid barrier/slug between the red blood cells and the plasma due to the relative specific gravities of the red blood cells, plasma and gel. The gel prevents the red blood cells and plasma from re-mixing when the contents of the previously-centrifuged hematocrit tube are dispensed by, for example, plunging the sealed end of the capillary tube. The thixotropic gel effectively prevents re-mixing even when the hematocrit tube is inverted.

After centrifugation, the plasma is typically dispensed into a small collection vial from which a sample is taken for testing. The remainder of the plasma remains stored in the vial for future testing. However, since the storage vial is too small to display an identification label, the small collection vial is stored in a second, larger vial to which the identification label is applied. This procedure is costly since two vials must be used.

Furthermore, this wasteful procedure cannot be cured by initially dispensing the contents of the hematocrit into a vial large enough to bear an identification label. Larger vials have a storage reservoir that is much larger than the small plasma sample. If the small plasma sample was deposited into such a large reservoir, the small volume of plasma would spread out over a large area within the storage reservoir and become too shallow to pipette.

To reduce waste, it has been proposed to dispense a small amount of plasma from the hematocrit tube for testing, and then to store the remaining plasma in the hematocrit tube in a vial large enough to receive an identification label. However, over time, the thixotropic gel in the hematocrit tube hardens and loses its ability to mechanically separate the red blood cells from the plasma. Therefore, it would be desirable to provide an apparatus for storing a small (micro-sized) volume of plasma from a hematocrit tube that has a micro-sized storage reservoir but is large enough to bear a standard identification label. It would also be desirable to provide a method of dispensing a small (micro-sized) volume of plasma from a hematocrit tube, which doesn't have thixotropic gel, into the reservoir of the apparatus.

SUMMARY OF THE INVENTION

The invention provides an apparatus for storing a small (micro-sized) volume of blood plasma separated after fractionation from whole blood within a hematocrit (capillary) tube. The apparatus is also preferably large enough to receive and display a standard laboratory identification label. The apparatus is constructed and arranged to store the plasma from a wrapped hematocrit tube, which does not include thixotropic gel.

In a preferred embodiment, the apparatus has a housing with a central axis, a top end, a bottom end, and side walls defining an internal cavity. The housing is intended to be used in an upright orientation that is vertical; however, the apparatus may also be useful if it is oriented slightly skew to vertical.

The housing includes a wall that divides the internal cavity into an upper cavity and a lower cavity. The wall has a lower surface, an upper surface, and a plasma storage reservoir formed therein, which is optimally-sized for storing small (micro-sized) volumes of plasma. In one preferred embodiment, the reservoir has a cylindrical upper portion, a conical lower portion, and is integrally formed in the wall. A bore extends axially through the wall adjacent the reservoir.

The housing has a cap for closing the upper cavity and sealing the reservoir. The cap is preferably hinged to the housing and is movable between open and closed positions. The cap has a plug that properly aligns with and inserts into the upper cylindrical portion of the reservoir when the cap is rotated from an open position to a closed position to seal the reservoir.

A channel extends axially within the lower cavity from the bottom to the wall. The channel has elongate side walls, is connected to the lower surface of the wall, and is arranged co-axial with the bore. The channel has an axially-extending slit in at least one of the side walls. The channel includes a stop that is constructed and arranged to abut the edge of the overwrap on a wrapped capillary tube that is inserted into the channel. In one preferred embodiment, the channel is connected to, and preferably integrally formed with, at least one side wall of the housing.

In a preferred embodiment, the channel has an upper portion with an inner diameter ID1, which is slightly larger than the outer diameter OD1 of the unwrapped portion of a wrapped hematocrit tube with which the apparatus is intended to be used. The channel preferably has a lower portion with an inner diameter ID2, which is slightly larger than the outer diameter OD2 of the wrapped portion of a wrapped hematocrit tube with which the apparatus is intended to be used. A shoulder is formed at the interface between the upper and lower portions of the channel.

An annular collar surrounds the bore on the upper surface of the wall. The collar has an inner diameter less than the inner diameter of the bore and slightly less than the outer diameter OD1 of the unwrapped portion of a wrapped hematocrit tube with which the apparatus is intended to be used. In one preferred embodiment, the collar has a tapered radial thickness, which reduces proceeding axially from the upper surface of the wall.

In a preferred embodiment, the reservoir is centrally located, and the upper surface of the wall surrounding the reservoir slopes inwardly and downwardly toward the reservoir so that fluid on the upper surface of the wall flows into the reservoir when the apparatus is oriented in the upright orientation.

The invention also provides a method of storing a small (micro-sized) volume of plasma from a hematocrit tube that lacks thixotropic separation gel. The hematocrit tube contains whole blood, which has been centrifuged to separate the whole blood into plasma and red blood cells. The hematocrit tube has been maintained in an upright position to prevent re-mixing of the constituents.

Initially, the hematocrit tube is connected to a storage apparatus as described above. Next, only the plasma is dispensed into a cavity in the apparatus by plunging one end and expelling the plasma from the opposed end of the hematocrit tube. Preferably, the plasma is dispensed by inserting a plunger rod into a proximal end of the hematocrit tube and pushing a plug toward a distal end until the plasma exits the distal end of the hematocrit tube. The plasma is then conveyed from the cavity to a reservoir. The reservoir is then sealed. While connecting the hematocrit tube to the apparatus and dispensing the plasma, the red blood cells and plasma are prevented from re-mixing by maintaining the hematocrit tube in a vertical orientation.

In one preferred embodiment, the conveying step comprises depositing the plasma onto a surface in the cavity that is inclined toward the reservoir, and allowing the plasma to flow into the reservoir. The apparatus in also maintained in a vertical orientation while conveying the plasma from the cavity to the reservoir to prevent spilling.

In a preferred embodiment, the amount of plasma inside the hematocrit tube is monitored by visually observing the distal open end of the hematocrit tube through an observation window in the apparatus. Monitoring the plasma level prevents the operator from over expelling the hematocrit tube, i.e., dispensing red blood cells into the upper cavity or reservoir.

With respect to the particular apparatus disclosed above, the hematocrit tube is inserted into the channel and pushed upwardly until the distal end of the hematocrit tube extends slightly past the collar. The plasma within the tube is then dispensed and collected within the reservoir by pushing the plunger plug of the hematocrit tube upwardly using a plunger. The plasma flows out of the hematocrit tube onto the upper surface of the wall, and then flows downwardly into the reservoir. The cap is then closed to seal the plasma within the reservoir. Plasma can be removed by opening the cap and pipetting a sample. The remaining plasma can be stored for future testing by closing the cap and re-sealing the reservoir.

In a preferred embodiment, the plunger comprises a metal rod that is fixed to and extends vertically from a base. The rod is small enough to be inserted into the hematocrit tube. The base is wide and heavy enough to stabilize the metal rod and enable insertion of the rod into the hematocrit tube without holding the metal rod.

In another embodiment, the invention comprises a system for collecting and storing blood plasma from a subject. The system comprises a wrapped hematocrit tube and the apparatus described above. The wrapped hematocrit tube has a first outer diameter OD1 of the unwrapped portion and a second outer diameter OD2 of the wrapped portion. The hematocrit tube has dimensions that cooperate with the apparatus in the manner described above. For example, the outer diameters of the unwrapped portion OD1 and wrapped portion OD2 of the hematocrit tube are slightly smaller than the inner diameters of the upper portion ID1 and lower portion ID2 of the channel. The length of the distal unwrapped portion of the hematocrit tube is slightly larger than the distance between the upper end of the collar and the internal shoulder of the channel. The internal diameter of the collar is slightly smaller than the outer diameter of the unwrapped portion of the hematocrit tube so that an interference fit is created when the tube is inserted into the collar.

DETAILED DESCRIPTION OF PREFERRED EMBODIMENTS

Figure 1:
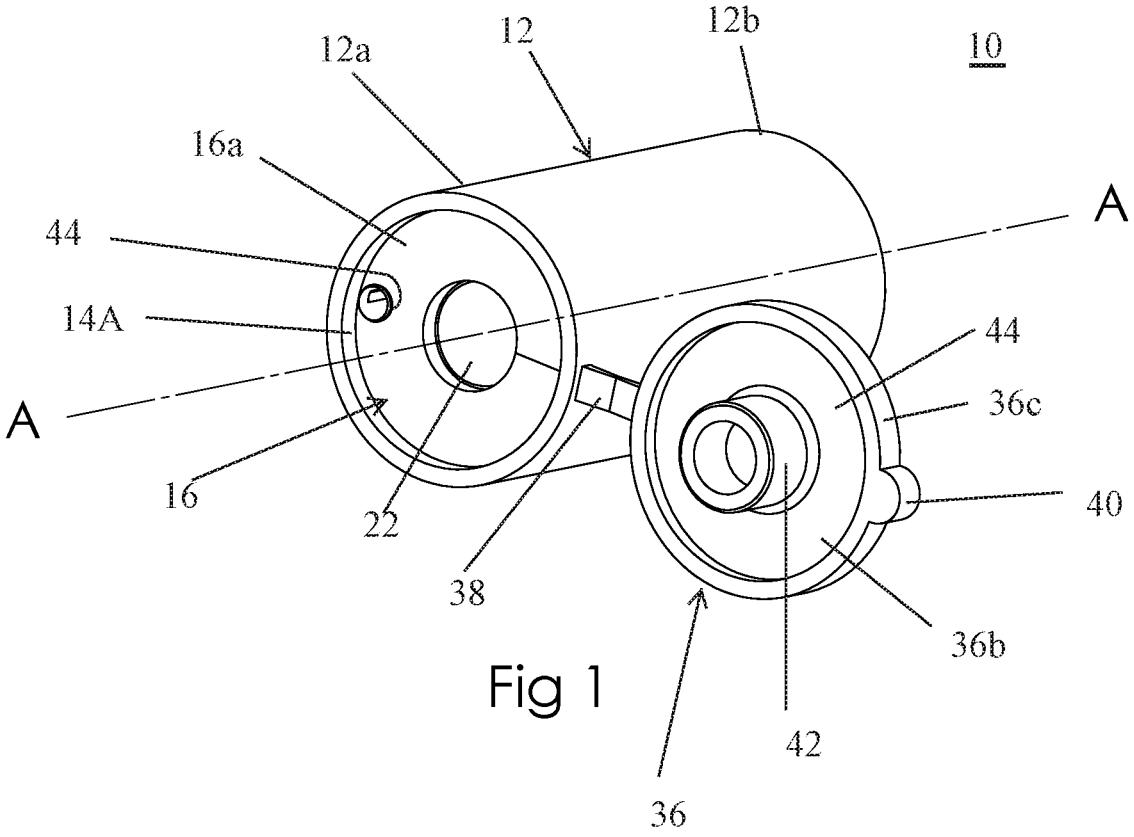
FIG. 1 is a top-end perspective of an apparatus in accordance with a preferred embodiment of the invention with the cap in the open position.

For the purpose of illustrating the invention, several embodiments of the invention are shown in the accompanying drawings. However, it should be understood by those of ordinary skill in the art that the invention is not limited to the precise arrangements and instrumentalities shown therein and described below. Throughout the specification, like reference numerals are used to designate like elements.

Throughout the specification, as used in connection with various elements and portions of elements, the following definitions apply: "distal" and "proximal" refer to their spatial relationship relative to the operator using the invention; "wrapped hematocrit tube" "HT" means a glass capillary tube "GL" having a protective safety overwrap of protective film "W", such as polyethylene terephthalate, which envelops the outer surface of the capillary tube except for a short distal portion "HTD" and short proximal portion "HTP"; "top" and "bottom" of the apparatus refer to their spatial relationship when the apparatus is correctly oriented for its intended purpose as described herein.

An apparatus in accordance with preferred embodiments of the invention is shown in FIGS. 1-17 and is designated generally by reference numeral 10. The apparatus has particular use with a wrapped hematocrit tube. The apparatus 10 functions best when used in the upright orientation shown in FIGS. 12-17 in which its central axis "A" is oriented vertically. However, it should be understood that the apparatus could still be used if it is oriented slightly skew to vertical.

The apparatus has a generally-cylindrical housing 12 having a top end 12*a*, a bottom end 12*b*, and side walls 14. In this embodiment, the housing 12 is cylindrical but could have other cross-sectional shapes. The housing 12 has an irregularly-shaped, radially-extending wall 16 proximate the top end 12*a* of the housing 12. The wall 16 has an upper surface 16*a* and a lower surface 16*b*, and is fixed to or integrally-formed with the side walls 14. The wall 16 divides the internal cavity into an upper cavity 18 and a lower cavity 20. With reference to the upright orientation shown in FIGS. 2, 4, 5, 7 and 8, the upper cavity 18 is defined by the interior surface of a short, upper portion 14*a* of the side walls 14 and the upper surface 16*a* of the wall 16. The lower cavity 20 is defined by the interior surface of a long, lower portion 14*b* of the side walls and the lower surface 16*b* of the top wall 16.

Figure 8:
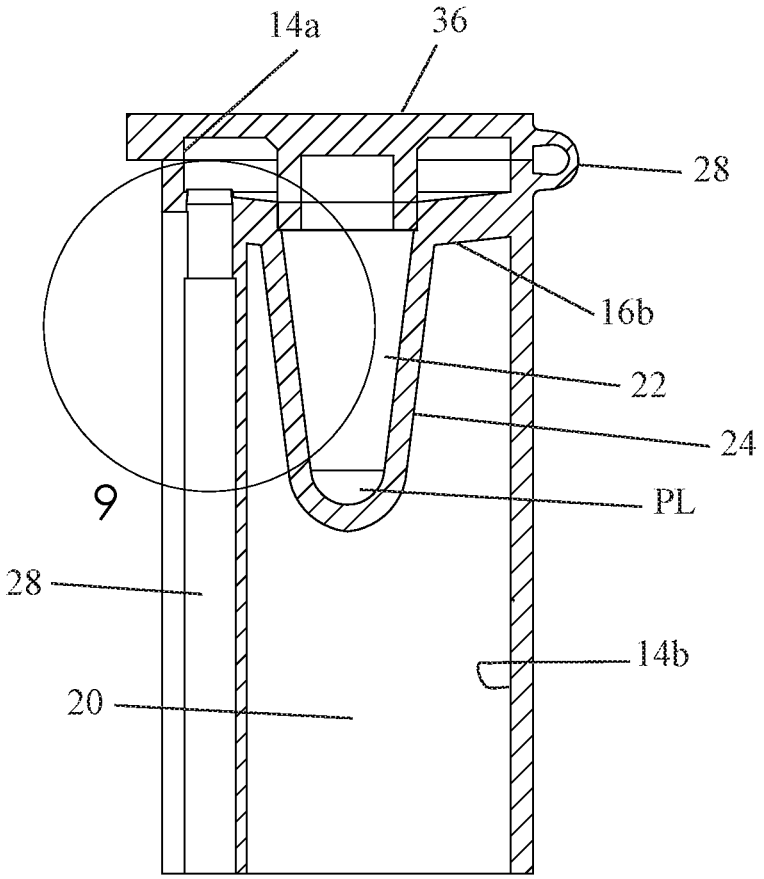
FIG. 8 is a cross-section taken along lines 8-8 of FIG. 7.
Figure 9:
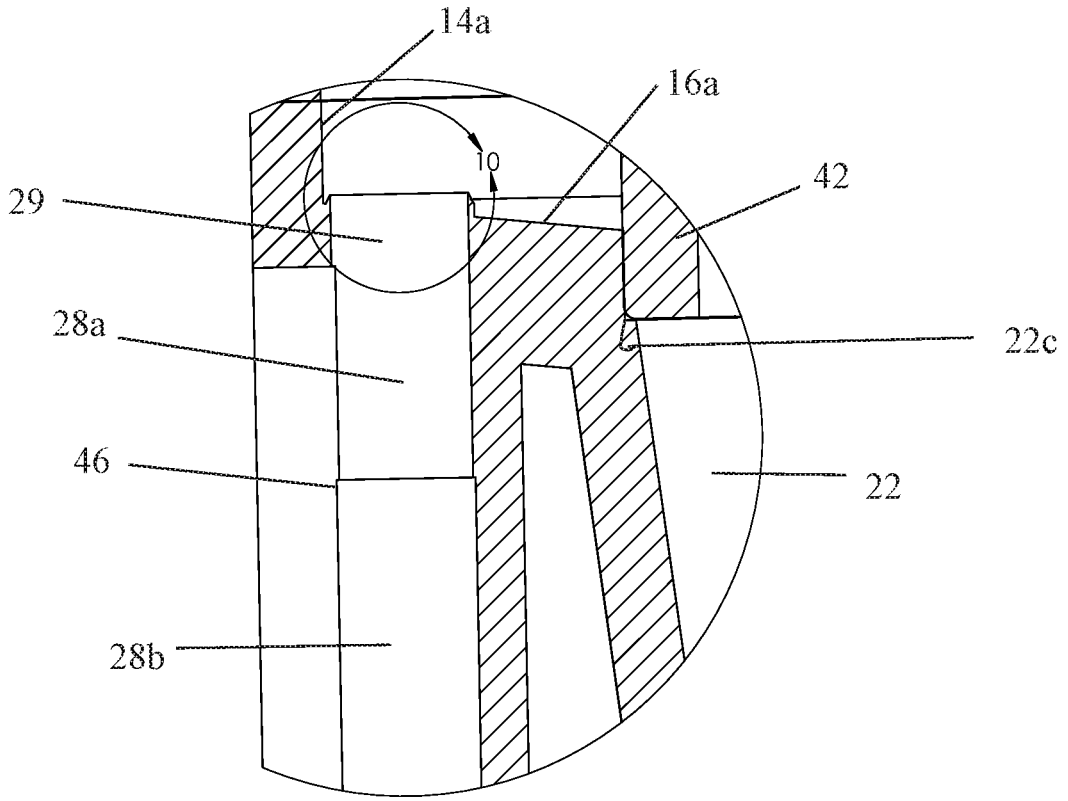
FIG. 9 is an enlarged, fragmentary view taken from FIG. 8.
Figure 10:
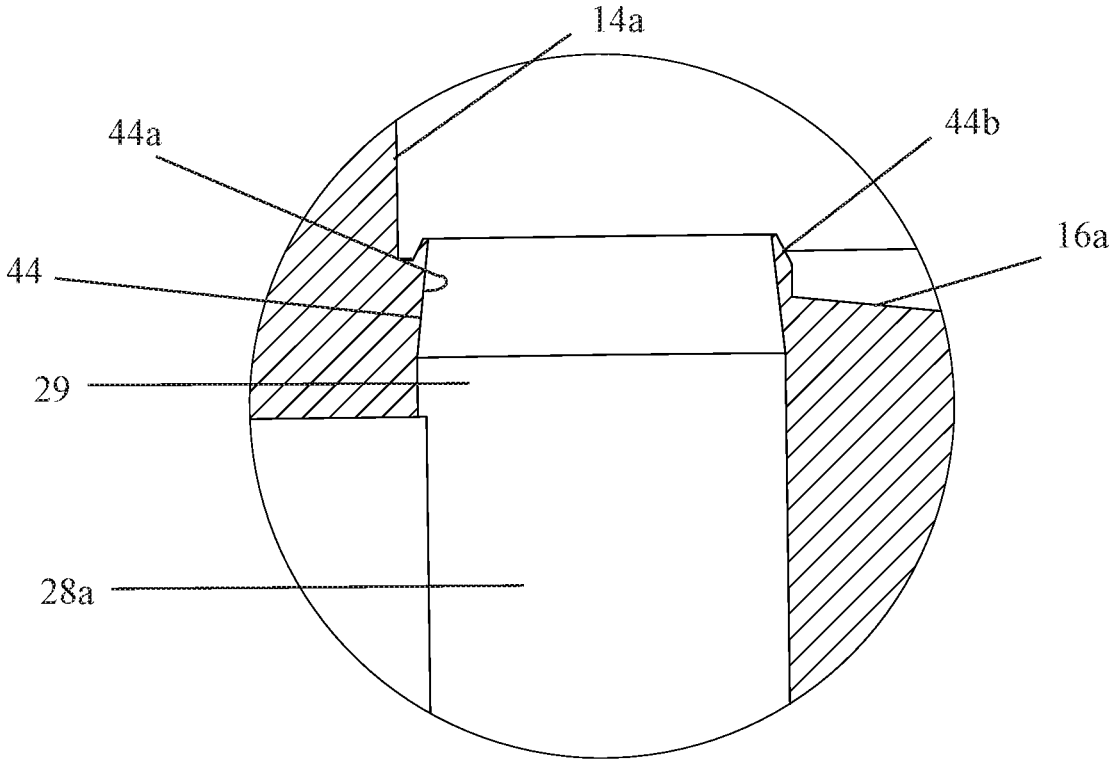
FIG. 10 is an enlarged, fragmentary view taken from FIG. 9.

In a preferred embodiment, a reservoir 22 is formed in the upper surface 16*a* of the wall 16. As described below, the reservoir 22 is designed to store fluid emitted from a hematocrit tube. In the embodiment shown in FIGS. 1-17, the reservoir 22 has a cylindrical upper portion 22*a* and a conical lower portion 22*b*, and is integrally formed in the wall 16. The reservoir walls 24 extend axially into the lower cavity 20. The reservoir 22 has a generally circular opening 26 at the top of the cylindrical upper portion 22*a*, which allows fluid to flow from the upper cavity 18 into the reservoir 22. As best seen in FIGS. 9 and 10, most of the upper surface 16*a* of the wall 16 slopes downwardly toward the reservoir 22 so that any fluid deposited on the upper surface of the top wall 16 flows into the reservoir 22 when the apparatus 10 is arranged in the upright orientation.

In the preferred embodiment shown in FIGS. 1-17, the reservoir 22 is centrally located on the top wall as best seen in FIGS. 1, 5, 6 and 8. However, in other preferred embodiments, the reservoir 22 may be offset from the central axis and located anywhere in or on the upper surface 16*a* of the top wall 16. No matter where the reservoir 22 is located, the top surface 16*a* should preferably be shaped and sloped so that any fluid deposited on the upper surface 16*a* flows downwardly toward and into the reservoir 22 when the apparatus 10 is arranged in the upright orientation.

The volume of the reservoir 22 is preferably selected based on the size of the hematocrit tube with which the apparatus will be used. In a preferred embodiment, the plasma storage reservoir 22 is optimally-sized for storing a small (micro-sized) volume of plasma. For small rodent blood sticks, the volume of the reservoir 22 may be very small since the amount of blood withdrawn from the rodent is very small. For example, in the embodiment shown in FIGS. 1-17 for small rodent blood sticks, the reservoir 22 may have a volume of less than 100 microliters.

Preferably, the shape and dimensions of the reservoir 22 are selected to that the depth of the plasma "PL" within the reservoir 22 is sufficient to allow removal by pipetting. For example, referring to FIGS. 8 and 11, the reservoir 22 is deep and has a small cross section so that the plasma level is sufficiently deep to allow removal by pipetting. The deep, narrow reservoir 22 compliments the shape of a pipette.

Figure 5:
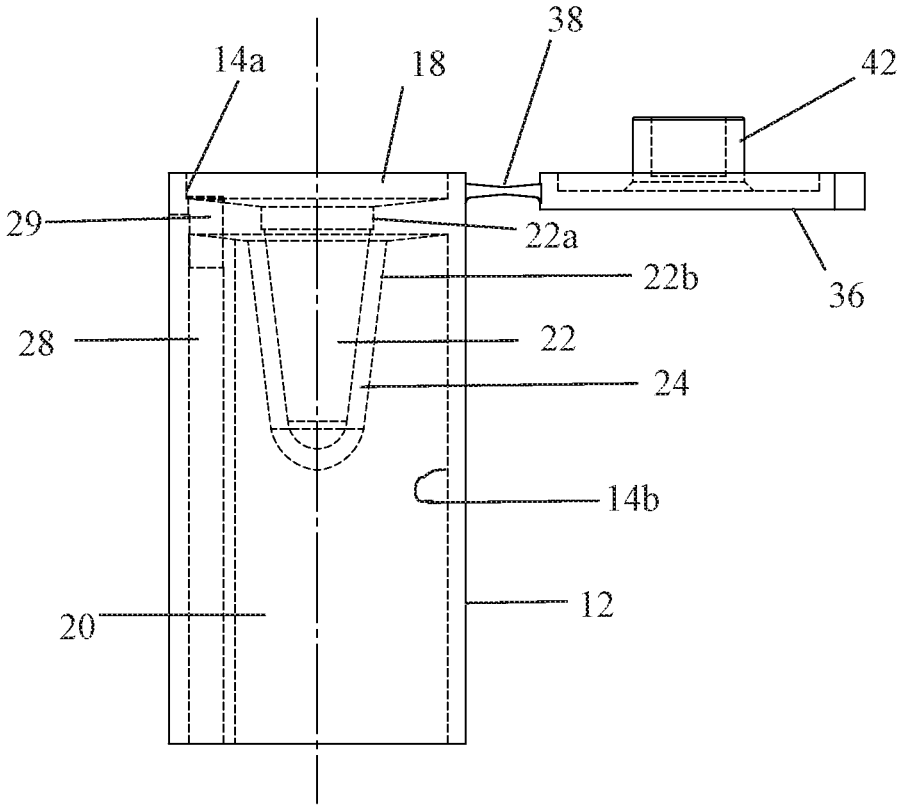
FIG. 5 is a side view with hidden lines of the apparatus of FIG. 1 with the cap in the open position.
Figure 6:
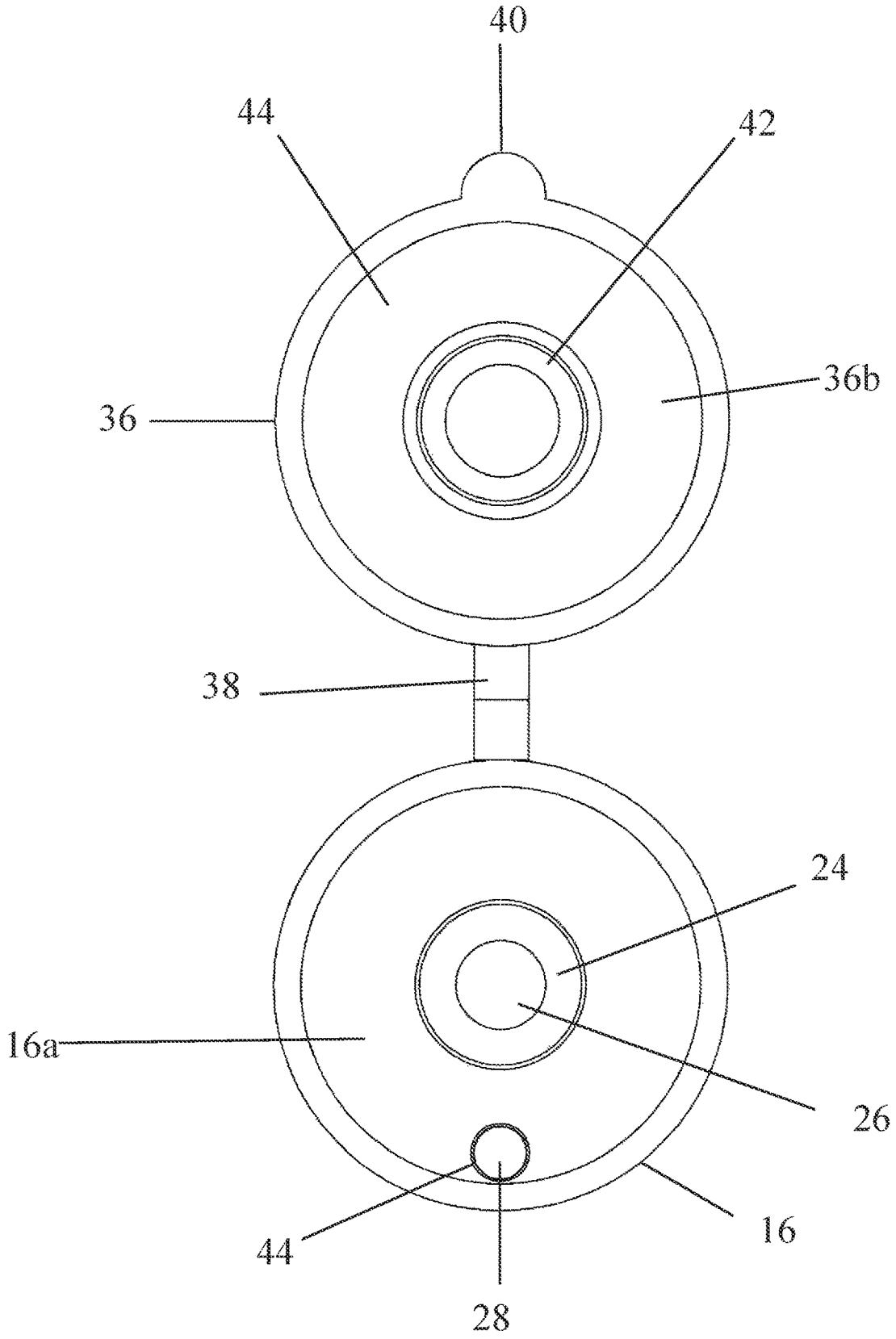
FIG. 6 is a top plan of the apparatus of FIG. 1 with the cap in the open position.
Figure 7:
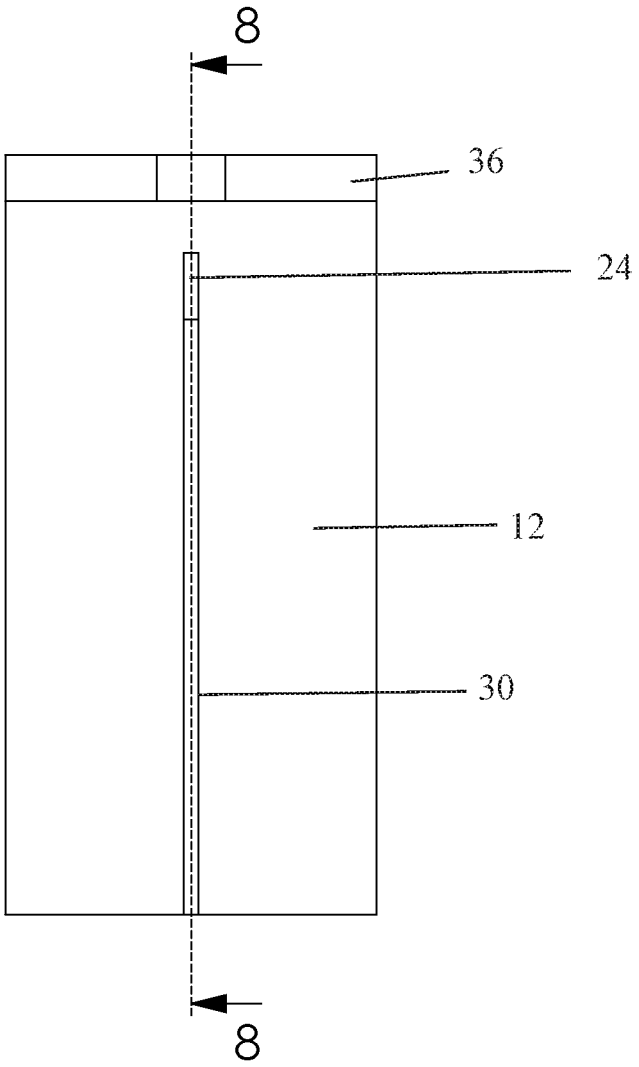
FIG. 7 is side elevation of the apparatus of FIG. 1 with the cap in the closed position.

A cap 36 is movably-connected to the upper portion 14*a* of the sidewalls 14. The cap 36 is movable between an open position, such as shown in FIGS. 1, 5 and 6, and a closed position shown in FIGS. 2, 4, 7 and 8. In the embodiment shown in FIGS. 1-17, the cap 36 is connected by a hinge 38 comprising a flexible strip of the same material from which the housing 12 is formed. In this preferred embodiment, the hinge 38 is integrally formed with both the cap 36 and the side walls 14 by injection molding.

Figure 3:
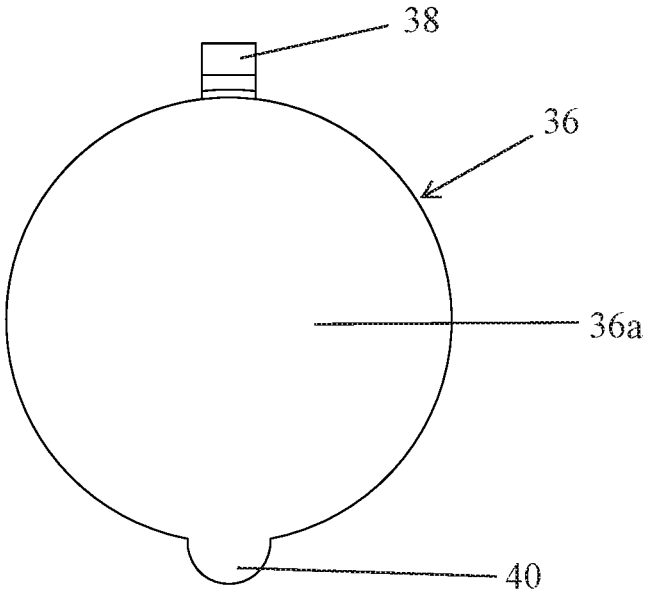
FIG. 3 is a top plan of the apparatus of FIG. 1 with the cap closed.
Figure 4:
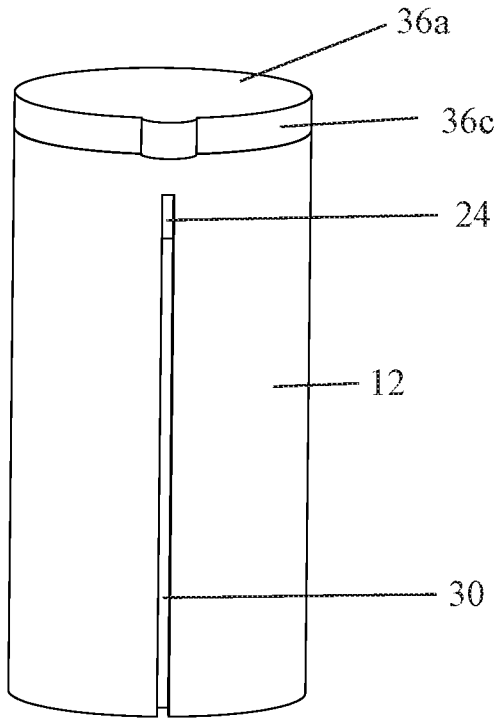
FIG. 4 is a front perspective of the apparatus of FIG. 1 with the cap closed.

The cap 36 has a flat, circular outer surface 36*a*, and an irregularly-shaped inner surface 36*b*, and cylindrical side walls 36*c*. The size and shape of the cap 36 generally compliments the size and shape of the housing 12. The hinge 38 is preferably integrally formed with the side walls 36*c*. A tab 40 is fixed to and extends generally radially from the side wall 36*c*. In a preferred embodiment, the tab 40 is integrally formed with the side wall 36*c* at a location diametrically opposed to the hinge 36 as best seen in FIGS. 3 and 6.

The inner surface 36*b* of the cap 36 includes a centrally-located plug 42, which extends generally perpendicular to the inner surface 36*b*. In this embodiment, the plug 42 has a generally-cylindrical shape and size that compliments the shape and size of the upper cylindrical portion 22*a* of the reservoir 22 as best seen in FIG. 8. In this embodiment, an annular recess 44 surrounds the plug 42; however, the cap 36 may be formed without this recess 44.

Figure 11:
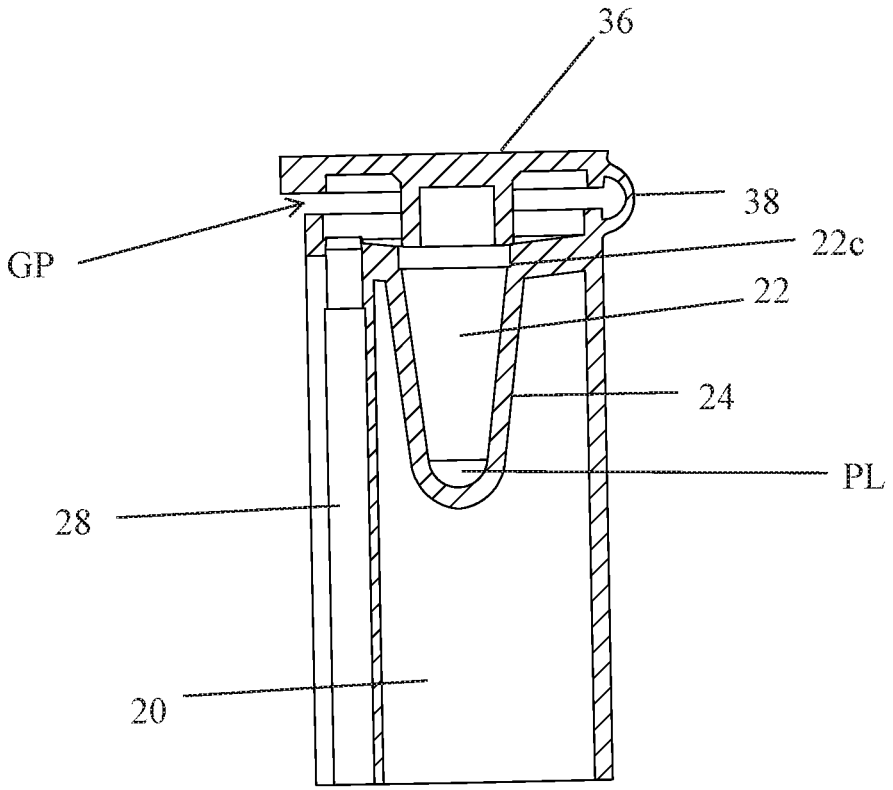
FIG. 11 is a cross-section similar to FIG. 8 but with the cap not fully closed.

The plug 42 is located on the cap 36 so that the plug 42 properly aligns with and inserts into the upper cylindrical portion 22*a* of the reservoir 22 when the cap 36 is rotated from an open position to a closed position. In FIG. 11, the plug 42 is partially inserted into the upper cylindrical portion 22*a* of the reservoir 22. To fully close the cap 36 and seal the reservoir 22, the cap 36 must then be depressed axially until the plug 42 seats against the shoulder 22*c* between the upper cylindrical portion 22*a* and lower conical portion 22*b* of the reservoir 22.

In a preferred embodiment, the dimensions of the plug 42 and reservoir 22 are selected so that the cap 36 also closes the upper cavity 18. In the fully-closed position shown in FIG. 8, the inner perimeter of the cap 36 also abuts the upper perimeter of the housing 12 to close the upper cavity 18; however, this interface need not be water-tight since all of the plasma is sealed inside the reservoir 22. This closure mechanism can, however, help prevent the cap 36 from being accidentally opened during handling, especially if the plug 42 is not fully inserted in the reservoir 22. Since the plug 42 cannot be seen when the cap 36 is in the partially-closed position of FIG. 11, the gap "GP" shown in FIG. 11 serves as a closure indicator. Preferably, there should be no gap if the plug 42 has been fully inserted into the reservoir 22. Any remaining gap can be readily detectable (visually or by touch) by a laboratory technician and will be a warning to the technician that the cap 36 is not fully closed. When the gap "GP" is eliminated, the force required to open the cap 36 is maximized. Furthermore, when the gap "GP" is eliminated, only the tab 40 is used to pry the cap 36 open.

In this embodiment, the plug 42 is illustrated as a hollow construction to save material cost and to give the plug 42 greater flexibility (for re-alignment) in the case of any misalignment with the reservoir 22 when the cap 36 is closed. In other preferred embodiments, the cap 36 may have a solid structure.

Figure 2:
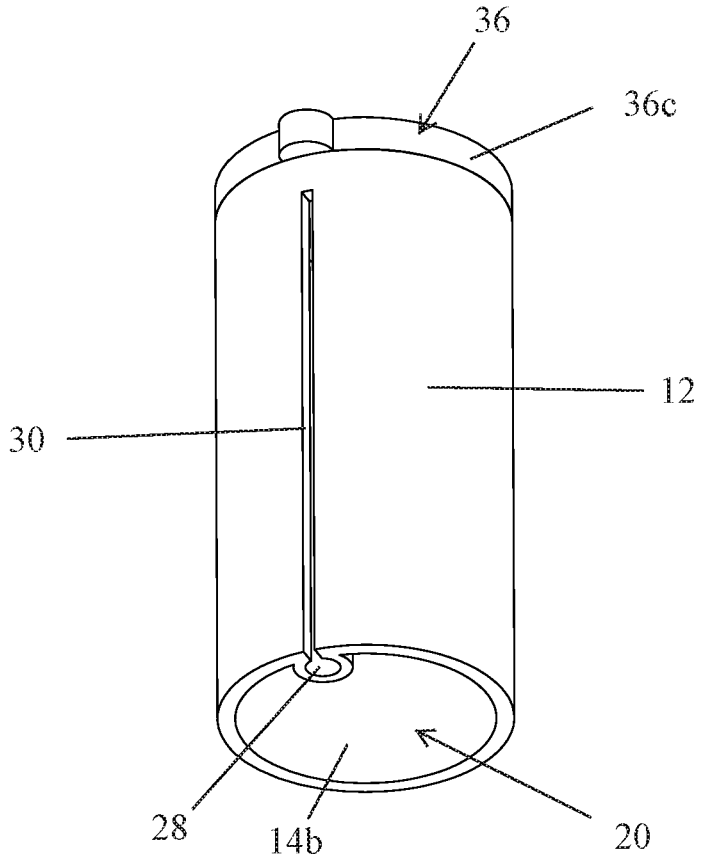
FIG. 2 is a bottom-end perspective of the apparatus with the cap closed.

Referring to FIGS. 2 and 5, a channel 28 extends along the housing side wall 14 from the bottom end 12*b* of the housing 12 to the top wall 16. In the embodiment shown in FIGS. 1-17, the channel 28 is generally-cylindrical except for an axial slit 30 in the portion of its periphery that overlaps the side wall 14. As described below, the slit 30 serves as an observation window in the housing 12 during expulsion of plasma "PL" from the hematocrit tube "HT". Referring to FIG. 2, in this embodiment, the channel 28 is integrally formed with the side walls; however, in other embodiments, the channel 28 may comprise a separate structure, which extends from the lower cavity to the top wall 16, and which may or may not contact the sidewall 14. Referring to FIG. 9, the channel 28 has an upper portion 28*a* with an inner diameter ID1, which is slightly larger than the outer diameter OD1 of the unwrapped portion of a wrapped hematocrit with which the apparatus is intended to be used. The channel 28 has a lower portion 28*b* with an inner diameter ID2, which is slightly larger than the outer diameter OD2 of the wrapped portion of a wrapped hematocrit with which the apparatus is intended to be used. The upper portion 28*a* and lower portion 28*b* of the channel 28 are integrally formed with each other and form a shoulder 46 at their intersection. Preferably, ID1 is smaller than OD2 so that the radial edge of the wrap abuts the shoulder 46 when the tube is inserted fully in the channel 28. The shoulder 46 limits the distance the hematocrit tube "HT" can be inserted in the channel 28.

In a preferred embodiment, the upper portion 28*a* of the channel 28 is integrally formed with and forms a continuous connection with the bore 29. Preferably, the inner diameter of the bore 29 is the same as ID1.

Referring to FIGS. 9 and 10, an annular collar 44 preferably surrounds the bore 29 and extends axially from the upper surface 16*a* of the wall 16. In one preferred embodiment shown in FIGS. 1-17, the collar 44 is integrally formed with the top wall 16 and forms a continuous connection with the bore 29. The inner surface 44*a* of the collar 44 is generally cylindrical while the outer surface 44*b* has an irregular shape. Referring to FIG. 10, the outer surface has a radially-inwardly tapered surface. As a result of this construction, the radial thickness of the collar 44 reduces proceeding axially-upwardly from the top wall 16, which gives the collar increased flexibility in the radial direction to grip the capillary tube as described below.

The dimensions of the apparatus are selected to optimally function with a wrapped hematocrit tube having the construction and outer diameters OD1 and OD2 described above. In the preferred embodiment shown in FIGS. 1-17, the inner diameter of the lower portion 28*b* of the channel 28 is slightly larger than OD2, and the inner diameter of the upper portion 28*a* of the channel 28 and the bore 29 is slightly larger than OD1 but smaller than OD2.

Figure 16:
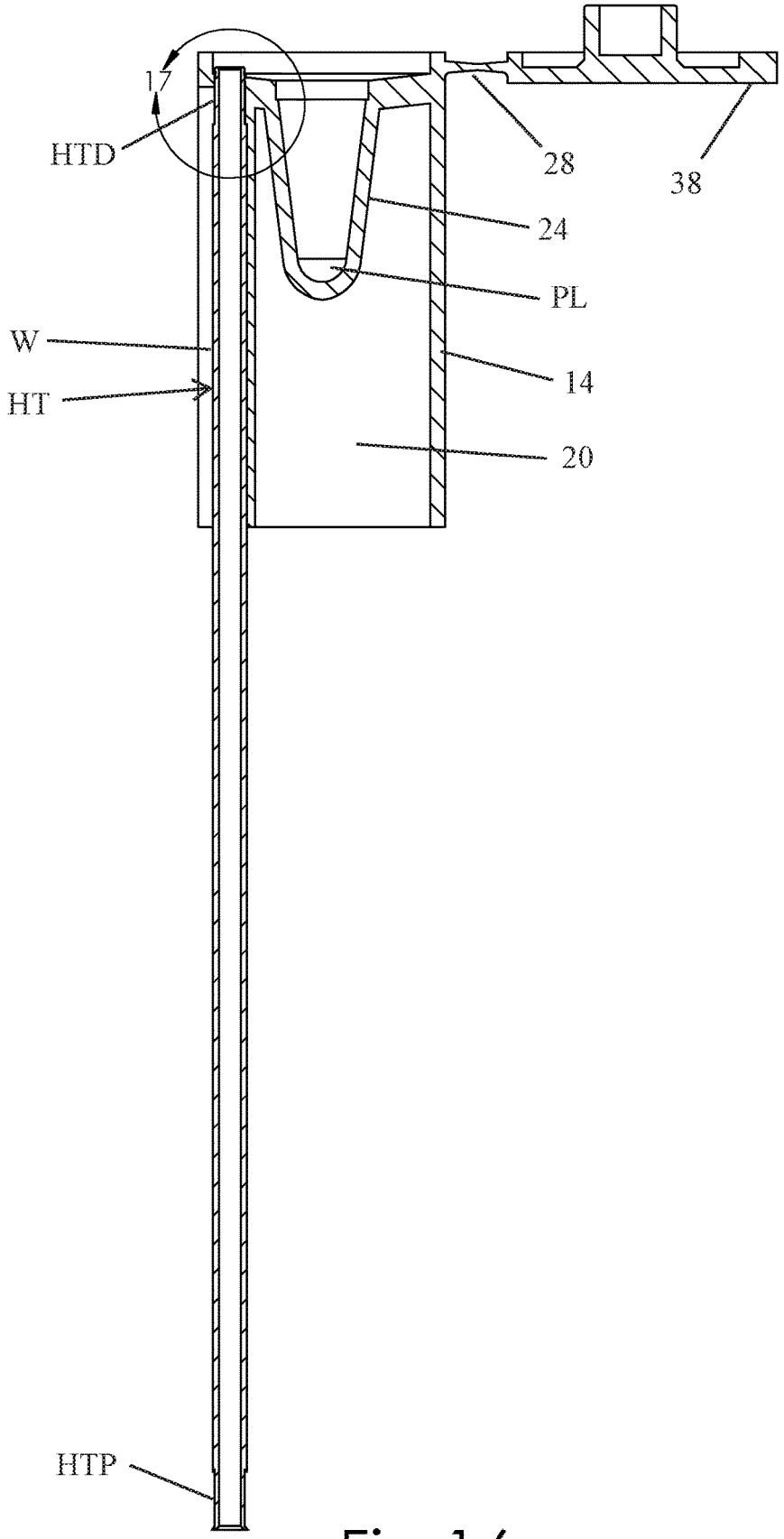
FIG. 16 is a cross-section of a wrapped hematocrit tube installed in the apparatus of FIG. 1; and, FIG. 17 is an enlarged, fragmentary view taken from FIG. 16.
Figure 17:
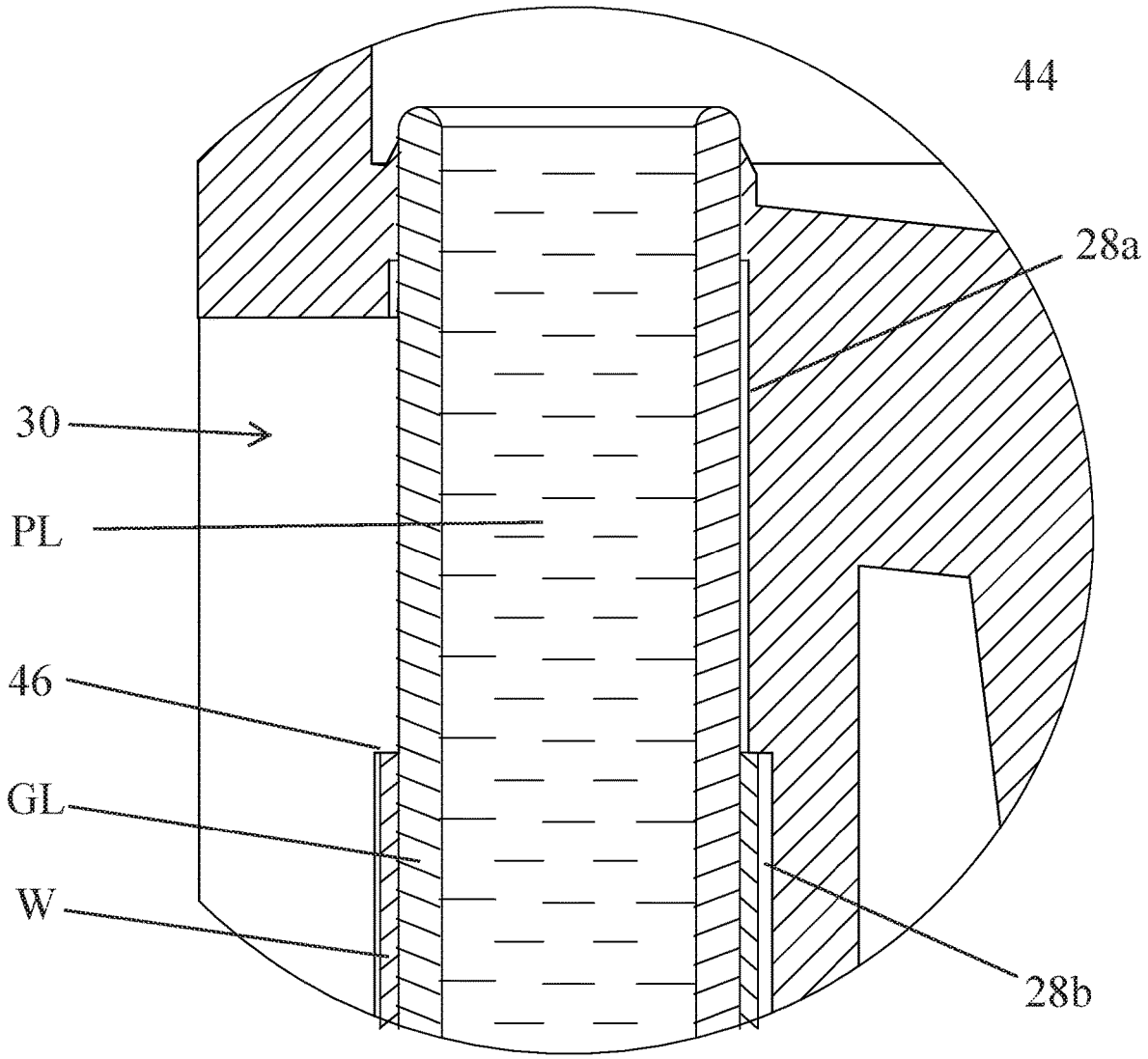

Preferably, the inner diameter of the collar 44 is slightly smaller than the inner diameter of the bore 29 and OD1. In a preferred embodiment, the inner diameter of the collar 44 tapers gradually inwardly as best seen in FIG. 10 to create the above-described reduced relative diameter; however, in another embodiment, the inner diameter of the collar 44 could have a constant reduced inner diameter, which forms a shoulder at the upper end of the bore 29. As a result of the reduced diameter of the collar 44, an interference fit is created between the collar 44 and unwrapped distal portion "HTD" of the hematocrit tube when it is inserted fully in the channel. The wrapped hematocrit tube can be inserted into the bottom of the channel, advanced upwardly and locked in place with the distal tip locked in and extending slightly beyond the collar 44 by a friction fit as shown in FIGS. 16 and 17.

In one preferred embodiment, all of the components are integrally formed by injection molding. One preferred material is polyethylene, which has particularly useful properties for the hinge 38. However, it should be appreciated by those of ordinary skill in the art that other polymers could be used.

Figure 12:
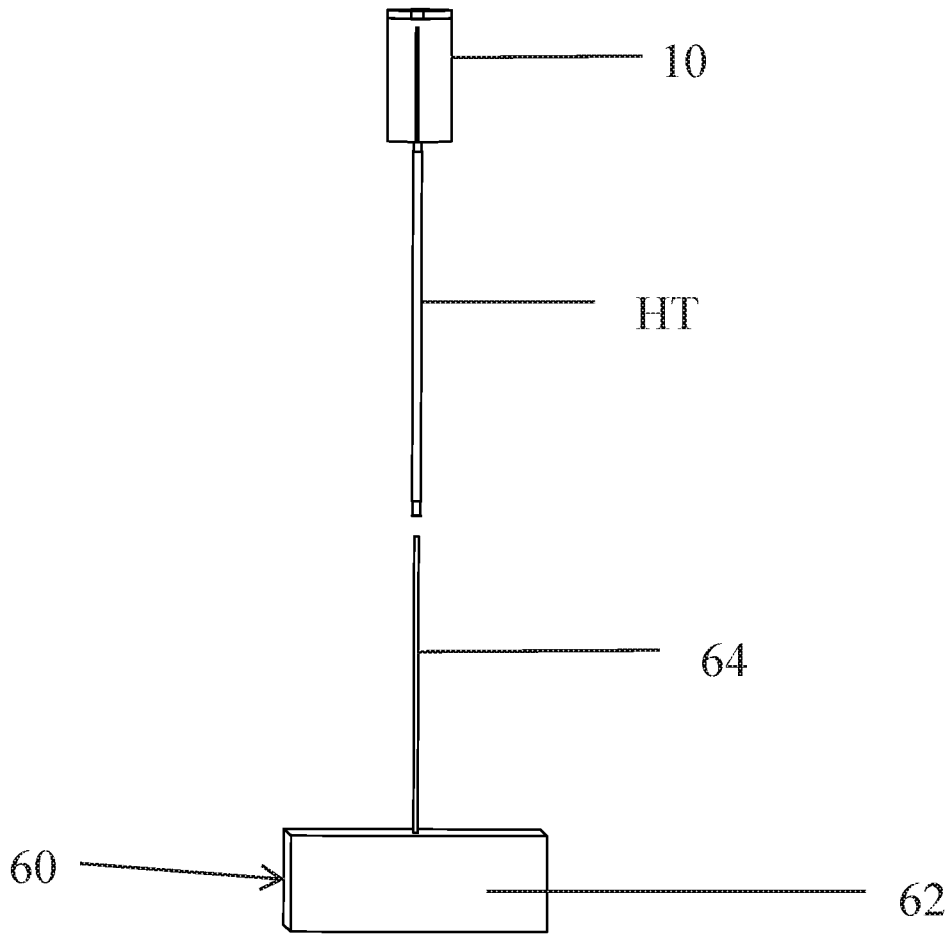
FIGS. 12 and 13 are side elevations of the apparatus being used with a plunger and wrapped hematocrit tube in accordance with another embodiment of the invention.
Figure 13:
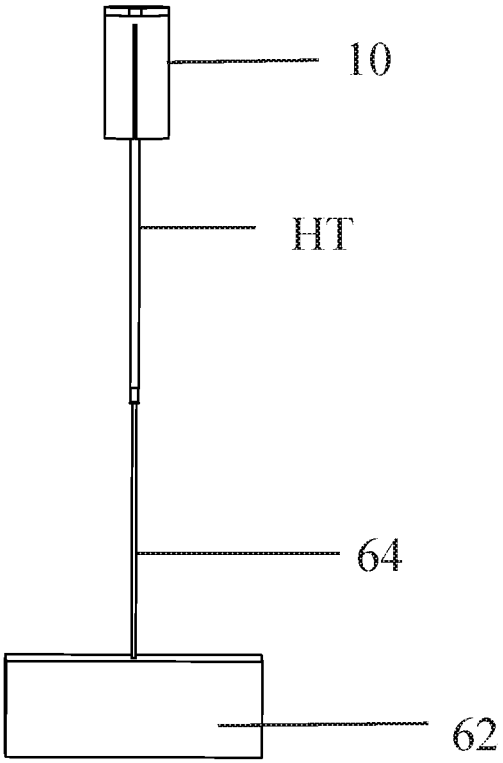

A plunger for expelling fluid from the hematocrit tube in accordance with another embodiment of the invention is shown in FIGS. 12 & 13 and is designated generally by reference numeral 60. The plunger 60 generally comprises a base 62 and an elongate metal rod 64 that extends vertically-upwardly from the base 62. In the embodiment shown in FIGS. 12 & 13, the base comprises a rectangular block of material that is heavy enough and wide enough at its bottom to provide good stability for the rod 64. The rod 64 may be permanently or removably fixed to the base 62.

Another embodiment of the invention provides a method of collecting and storing plasma "PL" from a wrapped hematocrit tube "HT" having an open end and a closed/plugged end. By using this method, the hematocrit tube need not contain a separating gel. The method is described with reference to FIGS. 12-17. In a preferred embodiment of the method, a whole blood sample is initially collected from a patient using the wrapped hematocrit tube "HT" and known sampling techniques. The hematocrit tube "HT" is then centrifuged to separate the whole blood sample into its constituents. The plasma "PL" is then expelled and stored in the apparatus 10 for testing using this novel method.

Referring to FIG. 12, the open end of the wrapped hematocrit tube "HT" is inserted into the bottom of the channel. Next, the hematocrit tube "HT" is pushed up the channel 28 until the open end of the hematocrit tube "HT" extends slightly past the top of the collar 44 as best seen in FIG. 17. As a safeguard from advancing the hematocrit tube too far, the dimensions of the collar 44, top wall 16 and channel 28 are selected so that the radial edge of the overwrap "W" abuts the shoulder 46 inside the channel 28 and prevents further advancement when the open end is properly positioned slightly past the top of the collar 44. Because the inner diameter of the collar 44 is slightly smaller than the outer diameter OD1 of the unwrapped portion of the hematocrit tube "HT", the hematocrit tube is held in position by an interference fit.

Figure 14:
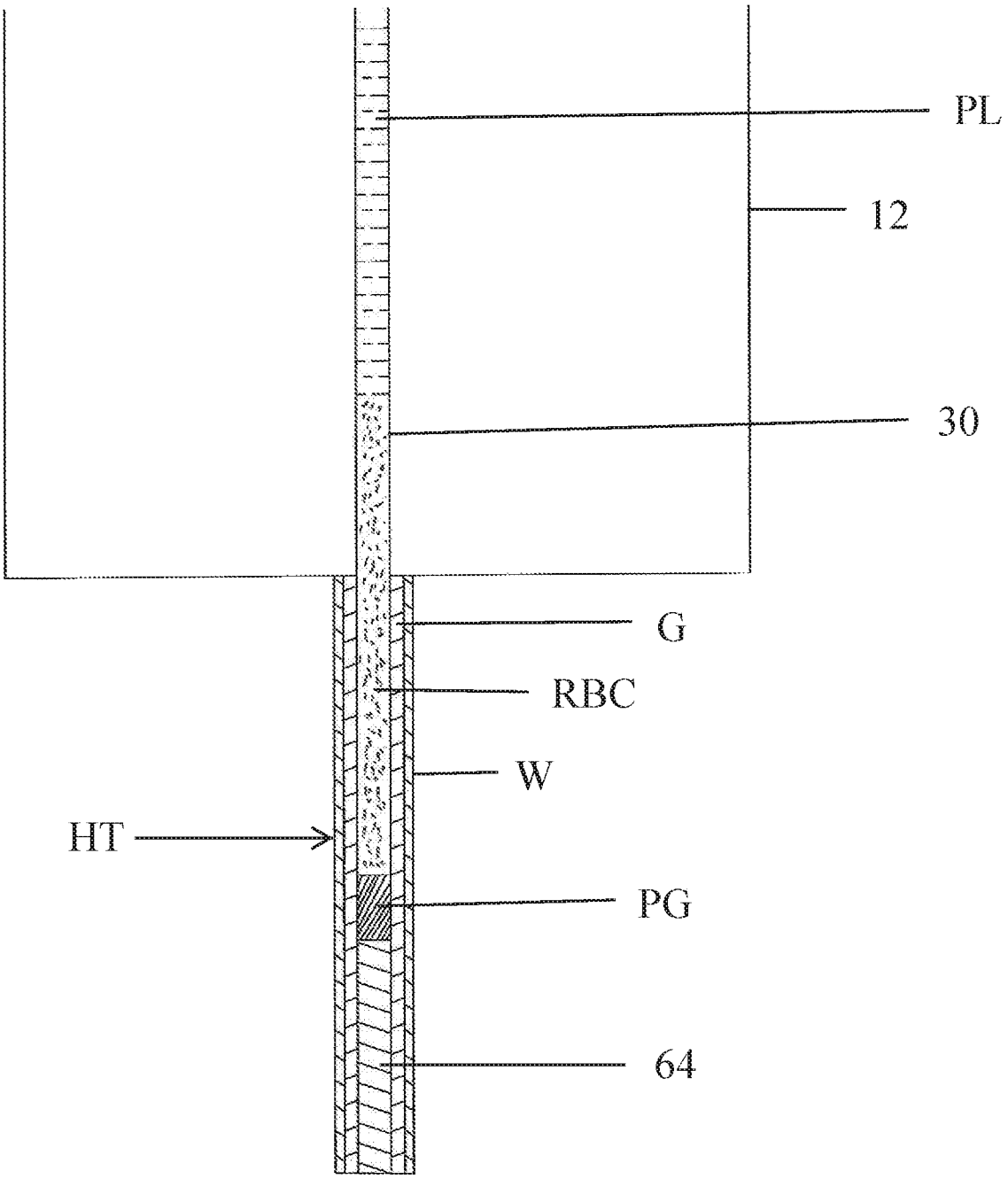
FIGS. 14 and 15 are sequential, fragmentary views showing the plunger rod dispensing plasma from the hematocrit.
Figure 15:
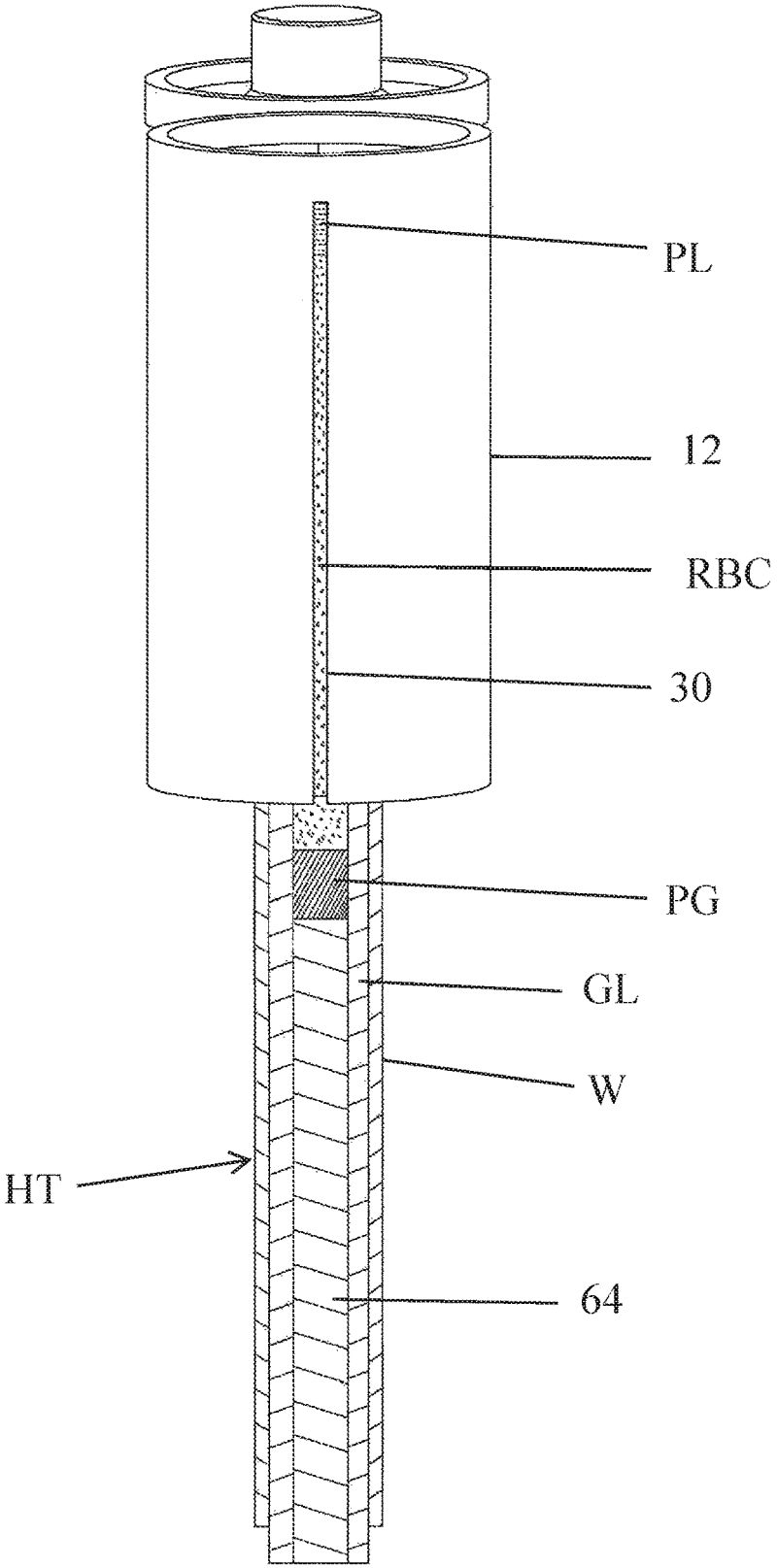

Next, the plasma "PL" is expelled from the hematocrit tube "HT" by pushing the plunger plug "PG" towards the distal open end of the hematocrit tube "HT". The plunger plug "PG" can be pushed using known, hand-held plungers or using the hands-free plunger 60 disclosed above. Referring to FIGS. 12 and 13, the closed, proximal end of the hematocrit tube "HT" is initially positioned over and then mounted on the plunger 60. As the hematocrit tube "HT" is forced downwardly on the rod 64, the rod 64 forces the plunger plug "PG" towards the open end and expels the plasma "PL" from the hematocrit tube, into the upper cavity 18, and onto the upper surface 16*a* of the wall 16. The plasma "PL" then flows down the wall 16 and into the reservoir 22. During expulsion, the operator can visually observe the fluid levels in the hematocrit tube "HT", and the location of the plunger "PG", through the slit 30 in the channel 28 as best seen in FIGS. 14 and 15, which show the sequential arrangement of the metal rod 64, plunger plug "PG", red blood cells "RBC", and plasma "PL" within the hematocrit tube "HT" after fractionation. In a preferred embodiment, the length and location of the slit 30 are selected so that the operator terminates expulsion once the red blood cell "RBC" level reaches the upper end of the slit 30. At this point, the operator closes the cap 36 to seal the reservoir 22, and then withdraws and discards the hematocrit tube "HT".

Finally, a standard identification label is applied to the apparatus 10. The dimensions of the apparatus 10 are selected and optimized so that the apparatus 10 is big enough to receive a standard laboratory label. In one preferred embodiment, the apparatus is about 0.8 in. high and has a diameter of about 0.5 in. The outer surface of the apparatus housing 12 may be countersunk in the region to which the label will be applied. Unlike prior art storage vials, the apparatus 10 need not be stored in another larger container to which the identification label is applied since the apparatus 10 itself is large enough to display the label. The apparatus 10 therefore reduces waste and the cost of storing excess plasma for future testing.

In another embodiment, the invention comprises the combination of an apparatus 10 as described above, and a wrapped hematocrit tube "HT" having dimensions that cooperate with the apparatus in the manner described above. For example, the outer diameter OD1 of the distal unwrapped portion "HTD" of the hematocrit "HT" is slightly smaller than the inner diameter ID1 of the upper portion 28*a* of the channel 28. The outer the diameter OD2 of the wrapped portion "W" of the hematocrit tube "HT" is slightly smaller than the inner diameters ID2 of the lower portion 28*b* of the channel 28. The length of the distal, unwrapped portion "HTD" of the hematocrit tube "HT" is slightly longer than the distance between the upper end of the collar 44 and the internal shoulder 46 of the channel 28. The internal diameter of the collar 44 is slightly smaller than OD1 so that an interference fit is created when the hematocrit tube "HT" is inserted into the collar 44.

The foregoing is considered as illustrative only of the principles of the invention. Further, since numerous modifications and changes will readily occur to those skilled in the art, it is not desired to limit the invention to the exact construction and operation shown and described herein, and accordingly, all suitable modifications and equivalents may be resorted to, falling within the scope of the invention. For example, the apparatus may be used in combination with an unwrapped hematocrit tube having an outer diameter less than the inner diameter of the bore and upper portion 28*a* of the channel 28. In this embodiment, the hematocrit tube has no wrap edge to abut the shoulder 46 within the channel to limit the insertion distance of the hematocrit tube within the channel 28; therefore, the operator must be careful to control insertion of the hematocrit tube until its distal fee end extends slightly past end of the collar.

The invention claimed is:

1. An apparatus for storing the fluid contents from a capillary tube, comprising:

a) a housing having an upright orientation, a central axis, a top end, a bottom end, and side walls defining an internal cavity;

b) a wall having an upper surface and a lower surface that divides said internal cavity into an upper cavity and a lower cavity;

c) a reservoir in said upper cavity;

d) a removable cap for sealing said reservoir, said cap being movable between open and closed positions; and, e) a channel within said lower cavity and extending axially to said wall.

2. The apparatus recited in claim 1, wherein said wall includes a bore extending axially through said wall adjacent said reservoir.

3. The apparatus recited in claim 2, including an annular collar surrounding said bore on said upper surface of said wall.

4. The apparatus recited in claim 2, wherein said channel has elongate side walls and is connected to said lower surface of said wall and is arranged co-axial with said bore.

5. The apparatus recited in claim 4, wherein said channel has an axially-extending slit in at least one of said side walls.

6. The apparatus recited in claim 4, wherein said channel includes a stop that is constructed and arranged to abut the edge of the overwrap on a wrapped capillary tube that is inserted into said channel.

7. The apparatus recited in claim 4, wherein the channel has an upper portion with an inner diameter ID1 and a lower portion with an inner diameter ID2, which is larger than ID1, and a shoulder formed at the interface between said upper and lower portions of the channel.

8. The apparatus recited in claim 1, wherein said channel is connected to at least one side wall of said housing.

9. The apparatus recited in claim 1, wherein said channel is integrally formed with at least one side wall of said housing.

10. The apparatus recited in claim 3, wherein said collar has a tapered radial thickness, which reduces proceeding axially from the upper surface of said wall.

11. The apparatus recited in claim 3, wherein the inner diameter of at least a portion of said collar is less than the inner diameter of said bore.

12. The apparatus recited in claim 1, wherein said reservoir is formed in said wall.

13. The apparatus recited in claim 12, wherein the upper surface of said wall surrounding said reservoir tapers downwardly toward said reservoir so that fluid on the upper surface of said wall flows into said reservoir when said apparatus is oriented in the upright orientation.

14. The apparatus recited in claim 1, wherein said reservoir has a cylindrical upper portion, a conical lower portion, and is integrally formed in said wall.

15. The apparatus recited in claim 14, wherein the cap has a plug 42 that properly aligns with and inserts into the upper cylindrical portion of said reservoir when the cap is rotated from an open position to a closed position to seal said reservoir.

16. A system for collecting and storing blood plasma from a subject, comprising:

a) a wrapped hematocrit tube having a first outer diameter OD1 of the unwrapped portion and a second outer diameter OD2 of the wrapped portion; and, b) an apparatus for storing the plasma from said hematocrit tube, comprising:

i) a housing having an upright orientation, a central axis, a top end, a bottom end, and side walls defining an internal cavity;

ii) a wall having an upper surface and a lower surface that divides said internal cavity into an upper cavity and a lower cavity;

iii) a reservoir in said upper cavity;

iv) a removable cap for sealing said reservoir, said cap being movable between open and closed positions; and, v) a channel within said lower cavity and extending axially to said wall, said channel having an upper portion with an inner diameter ID1 and a lower portion with an inner diameter ID2, which is larger than ID1, and a shoulder formed at the interface between said upper and lower portions of the channel;

wherein OD1 and OD2 are slightly smaller than ID1 and ID2, respectively.

17. The system recited in claim 16, wherein the length of the distal unwrapped portion of said hematocrit tube is slightly larger than the distance between the upper end of the collar and said shoulder in said channel.

18. The system recited in claim 17, wherein the internal diameter of said collar is slightly smaller than OD1 so that an interference fit is created when said hematocrit tube is inserted into said collar.

* * * * *